US009045196B2

(12) United States Patent
Hansen et al.

(10) Patent No.: US 9,045,196 B2
(45) Date of Patent: Jun. 2, 2015

(54) C-SHAPED RIGID BUOYANCY TUBE ASSEMBLY FOR BOATS

(76) Inventors: John F. Hansen, Tumwater, WA (US); Lloyd T. Hansen, University Place, WA (US)

( * ) Notice: Subject to any disclaimer, the term of this patent is extended or adjusted under 35 U.S.C. 154(b) by 256 days.

(21) Appl. No.: 13/549,099

(22) Filed: Jul. 13, 2012

(65) Prior Publication Data

US 2014/0014022 A1 Jan. 16, 2014

(51) Int. Cl.

| | |
|---|---|
| ***B63B 43/02*** | (2006.01) |
| ***B63B 3/14*** | (2006.01) |
| ***B63B 9/04*** | (2006.01) |
| ***B63B 43/04*** | (2006.01) |
| *B63B 3/18* | (2006.01) |

(52) U.S. Cl.

CPC ... *B63B 3/14* (2013.01); *B63B 3/18* (2013.01); *B63B 9/04* (2013.01); *B63B 43/04* (2013.01); *B63B 2043/047* (2013.01); *B63B 2241/08* (2013.01); *B63B 2241/10* (2013.01)

(58) Field of Classification Search

CPC ..... B63B 1/00; B63B 1/02; B63B 1/10; B63B 1/12; B63B 1/14; B63B 1/16; B63B 1/32; B63B 3/00; B63B 3/02; B63B 3/04; B63B 3/06; B63B 3/08; B63B 7/00; B63B 7/02; B63B 7/04; B63B 3/14; B63B 3/18; B63B 9/04; B63B 43/04; B63B 2043/047; B63B 2241/08; B63B 2241/10

USPC ..... 114/271, 283, 292, 61.1, 61.11, 61.2, 114/68, 43, 355, 356, 360, 364, 121, 122, 114/123

See application file for complete search history.

(56) References Cited

U.S. PATENT DOCUMENTS

| | | | | |
|---|---|---|---|---|
| 6,871,612 | B2 * | 3/2005 | Gursoy | 114/356 |
| 7,775,172 | B2 * | 8/2010 | Hansen | 114/123 |

* cited by examiner

*Primary Examiner* — Daniel V Venne
(74) *Attorney, Agent, or Firm* — Clark A. Puntigam; Jensen & Puntigam, P.S.

(57) ABSTRACT

The stabilizing tube assembly extends from the stern of the boat to the bow of the boat, the tube assembly comprising two half sections, each half section comprising a single piece of metal which is bent along a plurality of longitudinal lines for a portion thereof, from an aft end to a selected point along the length of the half-tube, forming a C-shape over said portion. The remainder thereof to the bow end is cut to produce a plurality of individual finger portions which are joined together to form a bow end with the other half-tube section or joined, respectively, to ends of a separate forward section to form a stabilizing tube bow.

10 Claims, 6 Drawing Sheets

C-SHAPED RIGID BUOYANCY TUBE ASSEMBLY FOR BOATS

TECHNICAL FIELD

This invention relates generally to stabilizing/buoyancy arrangements for a boat, and more specifically concerns a buoyancy structure which extends from the vicinity of the bow of the boat to the stern, providing enhanced stability for the boat.

BACKGROUND OF THE INVENTION

Various stabilizing arrangements for boats are known. Some stabilizing arrangements utilize foam tubes which extend around a portion of the boat. Examples of such structures are shown in U.S. Pat. No. 4,287,624 to Lowther and U.S. Pat. No. 5,647,297 to Hansen. Other stabilizing arrangements use inflatable tubes. Examples include U.S. Pat. Nos. 5,878,685 and 6,371,039, both to Hemphill, and U.S. Pat. No. 5,228,407 to Cummer et al. Rigid, hard-sided aluminum or fiberglass arrangements are also known, such as shown in U.S. Pat. No. 6,871,612 to Gursoy. Various cross-sectional configurations are known for such stabilizing tubes, including circular, D-shaped and rectangular arrangements.

The above arrangements do have disadvantages. In some arrangements, for instance, the tubes are arranged to provide only enough buoyancy to keep the vessel from sinking. Such arrangements are not considered to be true stabilized watercraft. Further, in many arrangements, performance is sacrificed by the particular design/configuration of the buoyancy structure. Still further, some arrangements provide satisfactory stabilization under certain conditions, but not in other conditions.

It would be desirable to have a stabilizing tube/buoyancy device which provides high static stability, as well as consistent high performance and sea-keeping ability, for various hull shapes, including deep-vee hull configurations. It is also desirable that the buoyancy device achieve a maximum static lateral stability for the boat, even when the boat is lightly loaded. It is further desirable that the buoyancy device be arranged to provide safety, stability and performance under a wide variety of sea conditions, in particular to provide buoyancy sufficient to maintain the vessel in an upright position and also allow the main deck of the cockpit to be self-bailing, such that water will evacuate on its own with no mechanical assistance, even under fully swamped conditions.

DISCLOSURE OF THE INVENTION

Accordingly, what is disclosed herein is a rigid stabilizing tube attachable to the hull of an otherwise fully functional watercraft, such that the stabilizing tube becomes integral with the hull, the stabilizing tube comprising: a stabilizing tube body which extends from the stern of the boat or beyond to the bow of the boat or beyond, the tube body comprising two half-tube sections, each half-tube section comprising a single metal member which is bent along a plurality of longitudinal lines for a portion thereof from an aft end to a selected point along the length thereof to form a C-shape, wherein the remainder to the bow end is cut to form a plurality of separate finger sections which are joined together to form, with the other half-tube-section, a stabilizing tube bow, or joined, respectively, to opposing ends of a separate forward section to form a stabilizing tube bow.

BEST MODE FOR CARRYING OUT THE INVENTION

Figure 1:
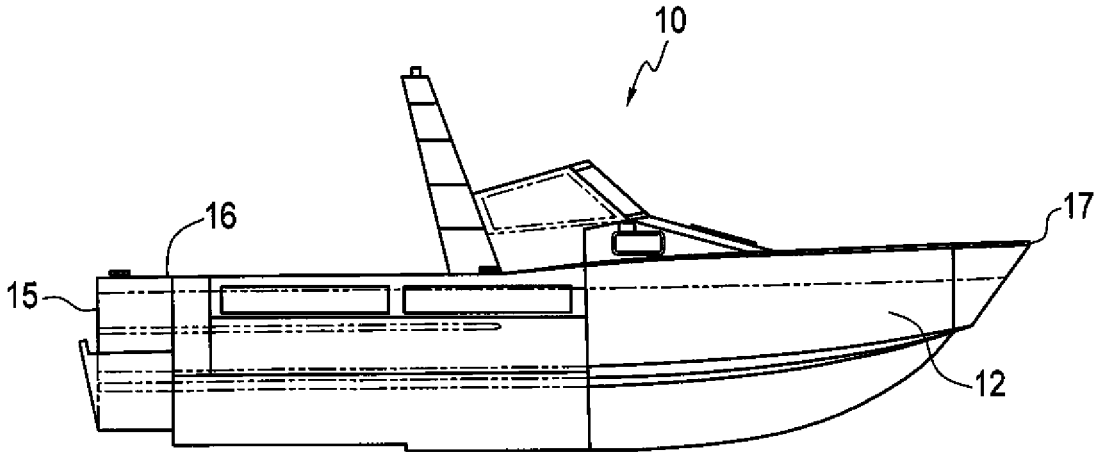
FIG. 1 is a side elevational view of the boat with the attached buoyancy device shown and described herein.

FIGS. 1-4 show a boat 10 with one embodiment of a stabilizer/buoyancy tube generally at 12. The stabilizer tube 12, also referred to herein as a buoyancy tube, extends from a point forward of the stem of the hull, defining a pointed bow 16 , to the stern 15 of the boat, in particular a selected distance beyond the end of transom 16. The buoyancy tube 12 in the embodiment shown is rigid, made from aluminum. It could also be made from other rigid metal or plastic material such as fiberglass. The buoyancy tube in the embodiment shown is approximately rectangular, approximately 27 inches high, although this could vary. While approximately rectangular, the buoyancy tube does have a unique cross-sectional configuration, which changes along its length as described in detail below.

The bottom portion 18 of the buoyancy tube 12 is wider than the upper portion 20 over a substantial portion of the length of tube 12. In one embodiment, the bottom portion 18 is approximately 14 inches wide. At approximately mid-height of tube 12, the width begins to decrease in a slight inward curve. At the upper end of tube 12 is an outwardly flared portion 22. The flared portion is approximately 4 inches high at the stern end of the tube, increasing to 12 inches or in some cases more at the bow, in the embodiment shown. The angle of the flare is within the range of 30°-80° (from the horizontal), with a preferred range of approximately 45°-75° toward the bow. A most preferred range toward the bow is 45°-50°. The flare does change from the stern to the bow of the boat. In the vicinity of the stern, the angle is 60°-80° (from the horizontal), preferably 70°-75°.

The overall dimensions of the buoyancy tube can vary to some extent to enhance the performance, safety and stability of the hull under different sea conditions, and also to ensure rigidity and impact mitigation. The tube in the embodiment shown, for instance, extends approximately 22 inches beyond the hull transom 16, which aids in the overall stability of the boat, increasing the buoyancy of the tube aft of the transom by as much as 50%. In some cases, the free rear ends 28 and 30 (FIG. 4) of the buoyancy tube are connected by an additional buoyancy piece 32, which further increases the overall buoyancy effect of the tube and the boat.

In the embodiment shown, the buoyancy tube has a dead rise 25 within the range of −45° to +25°, preferably in the range of 0° to +15° and most preferably approximately +12°.

Figure 2:
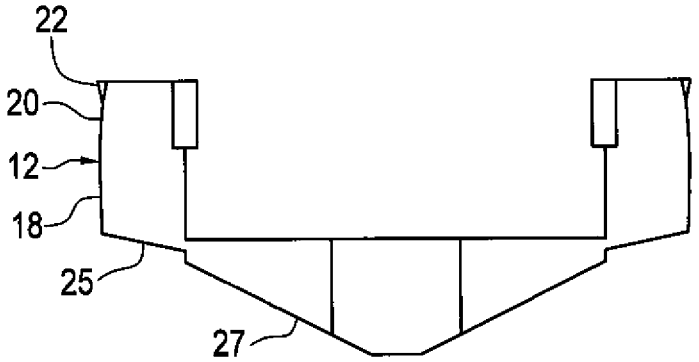
FIG. 2 is a lateral cross-sectional view of the boat and attached buoyancy device of FIG. 1.
Figure 3:
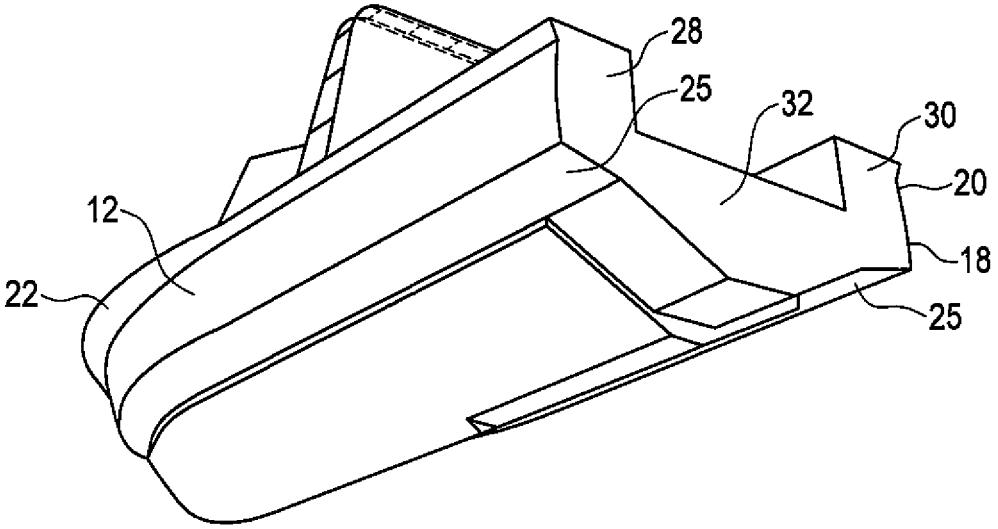
FIG. 3 is a perspective view, from below, of the boat and attached buoyancy device of FIG. 1
Figure 4:
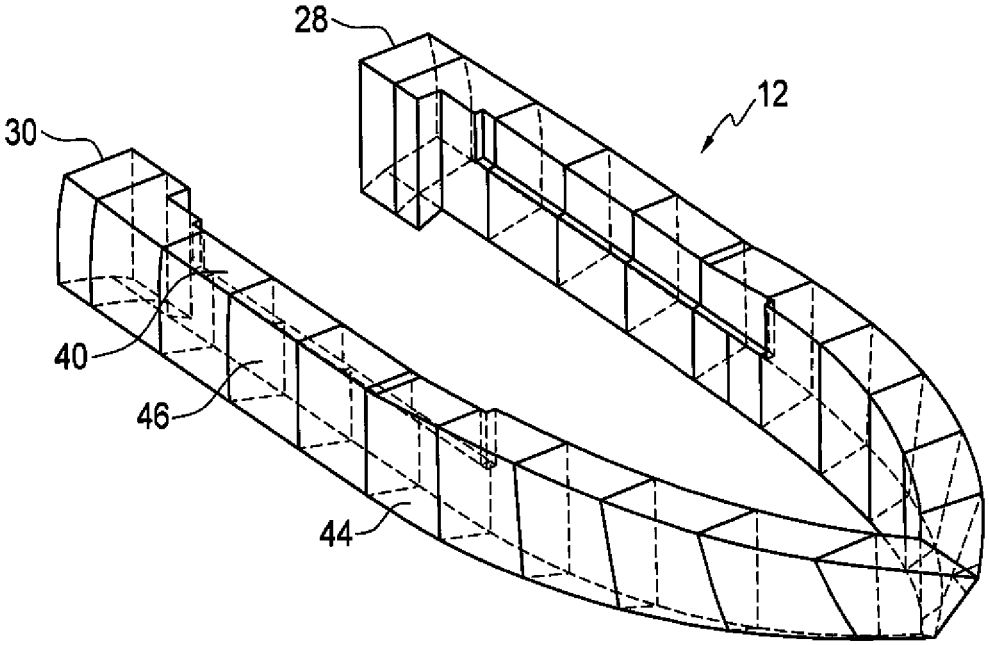
FIG. 4 is a perspective view of the buoyancy device itself.

The hull of a deep-vee boat, shown in FIG. 2, could have a dead rise 27 within the range of 15°-30°. In one specific example, the dead rise of the hull is 25°. The dead rise of the boat hull can vary significantly. The buoyancy tube is mounted so that the bottom edge of the tube is at the chine of the hull or within 4 inches above the chine. The preferred distance is 2 inches. The buoyancy tube is attached permanently to the boat by welding or the like, or alternatively, attached to a connecting member which in turn is secured permanently to the boat, and hence does not require a separate top and/or bottom mounting flange, which is usually required for an inflatable or foam tube.

In the embodiment shown, the cross-section of the tube will vary from the stern to the bow of the boat. Toward the rear of the boat, the lower portion of the tube will be larger than the upper portion thereof, as described above. However, as the tube extends toward the bow, the width of the lower portion thereof will decrease, such that toward the bow, the cross-section of the buoyancy tube becomes almost triangular, with a flat top surface 40, an inwardly angled outer surface 46 and a narrow lower surface 44 which decreases in width in the direction of the bow. This is shown most clearly in FIG. 4, which for clarity does not show the flair at the upper edge. The buoyancy tube is wider in the bottom portion aft of approximately amidship and wider at the top than the bottom forward of amidship; the outside of the buoyancy tube thus has a somewhat warped or twisted shape as it extends from the stern to the bow.

The rigid buoyancy tube shown in FIGS. 1-4 and described herein has a number of advantages. The particular configuration provides increased stability and buoyancy for a boat, particularly in the aft region, toward the stem of the boat. Improved lateral stability in both the static condition and at operating speed is due to the shape of the tube, in particular, the tube being wider at the bottom than at the top in the aft (stern) portion of the tube. This provides desired improved stability towards the stem of the boat. Forward of approximately amidship the tube diminishes in size, both in height and width of the lower portion thereof, and changes configuration, because less buoyancy is needed in that region. The tube terminates at a pointed bow, rather than a square or blunt bow as is the case of typical inflatable or foam tubes.

The overall shape of the tube increases the initial stability over other buoyancy arrangements and provides a maximum buoyancy at least as great as existing D-shaped foam tubes, while requiring less cross-sectional room, which is an important advantage. The flared portion at the top of the tube is also advantageous, in that it deflects spray during operation outwardly from the boat. The extension of the buoyancy tube beyond the stem of the hull, ending in a pointed bow, provides optimal capability in certain sea conditions. The position of the lower edge of the buoyancy tube, at or above, preferably 2 inches above, the chine of the hull, in combination with the dead rise angle of the buoyancy tube, reduce the wetted surface and drag for optimal performance and sea-keeping characteristics.

Another buoyancy tube assembly embodiment constructed for attachment to an existing or newly constructed boat hull is shown in FIGS. 5-11. The buoyancy tube assembly, referred to generally at 100, is a full size stabilizing C-shaped tube. Typically, the C-shaped tube 100 is made of rigid material such as aluminum or other metal, and is welded to the existing side plates 102 of a boat hull. The complete C-shaped tube 100 comprises two opposing single piece halves, each of which is constructed beginning with a flat sheet continuous metal member shown at 103 in dotted lines in FIG. 6. The sheet metal member 103 is cut to define a partially formed half-tube member shown in the solid lines at 101 in FIG. 6. The cut half-tube member 101 is defined longitudinally by outboard first and second longitudinal edges 104 and 106. A rear edge 108 defines the aft end of half-tube member 101. The half-tube member 101 is scribed for longitudinal bends along four longitudinal bend lines 112, 114, 116 and 118, from the aft end 108 of half-tube member 101 to a selected point along the length of the half-tube member, designated at 120 in FIG. 9. In the embodiment shown, this line is 55% of the total length of half-tube 101, the remainder of the half-tube being 45% of the total length of the half-tube. While this configuration is preferred, the length of longitudinal bending (to point 120) can vary to some extent.

Figure 5:
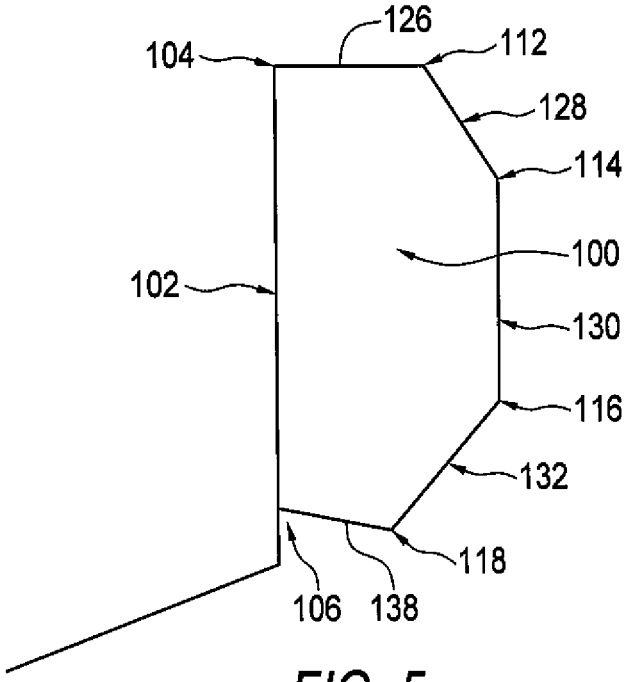
FIG. 5 is a cross-sectional elevational view of a C-shaped buoyancy device attached to a hull.

The aft 55%, referred to at 121, is bent along the scribed bend lines. An upper scribe section 126 is defined between upper edge 104 and scribe line 112. This section is horizontal in the final arrangement as shown in FIG. 5, with free edge 104 being fixedly connected to the hull. The bend angle along line 112 in the embodiment shown is approximately 45°, ±10°. The half-tube member is next bent along scribe line 114 at an angle of approximately 45°, although this angle can also vary. This defines upper middle scribe section 128, which is about 8 inches in the embodiment shown. The bend angles at scribe lines 112 and 114 should total about 90°.

The half-tube member is next bent along scribe line 116, a bend back toward the hull as shown in FIG. 5. The portion of the half-tube member between scribe lines 114 and 116 is referred to as the center middle scribe section 130 and is approximately vertical in orientation when the half-tube member is attached to a boat hull, as shown in FIG. 5. The width of this section can vary, but in one embodiment is approximately 12 inches. The half-tube member is next bent again, along scribe line 118. This defines a lower middle section 132, between scribe lines 116 and 118, which in the embodiment shown is approximately 8 inches. The angle of bending, in the embodiment shown, is approximately 45°±10°, and is similar to the angle along scribe line 114, except in the direction of the hull.

The angle along scribe line 118 is such that the last section of the half-tube member defined between scribe line 118 and lower free edge 106, is typically at a slight upward (positive) angle, as shown in FIG. 5, although it could be horizontal or at a downward (negative) angle. This is referred to as bottom section 138. In the embodiment shown, bottom section 138 is approximately 6 inches wide. The free edge 106 of bottom portion 138 is attached to the hull of the boat. The attachment point could be at the chine or up to 8 inches above the chine. This completes the bending of the half section in a continuous C-shaped form. The widths of the various sections can be varied independently. The half-tube member could be symmetrical about a center line or could be asymmetrical, with different angles. The half-tube member is generally C-shaped, however, with the upper and lower free edges 104 and 106 being attached to the hull.

Figure 7:
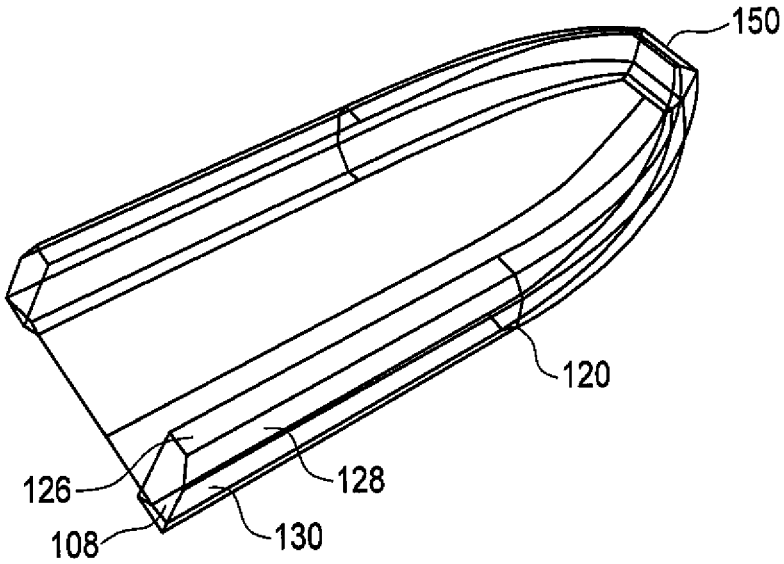
FIG. 7 is an isometric view of the buoyancy tube assembly of FIG. 5.
Figure 6:
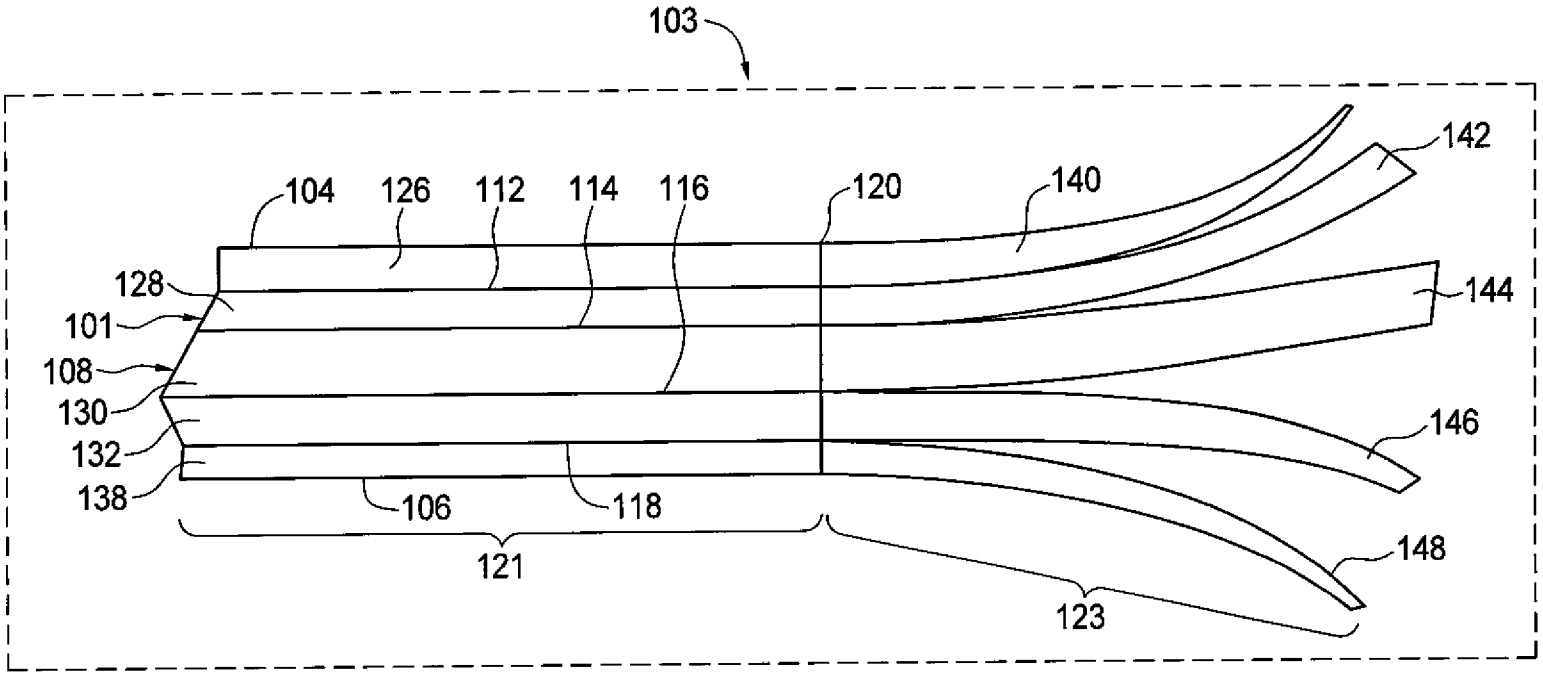
FIG. 6 is an elevational view of a metal member which has been cut prior to construction of one half of the buoyancy tube of FIGS. 5-8.
Figure 8:
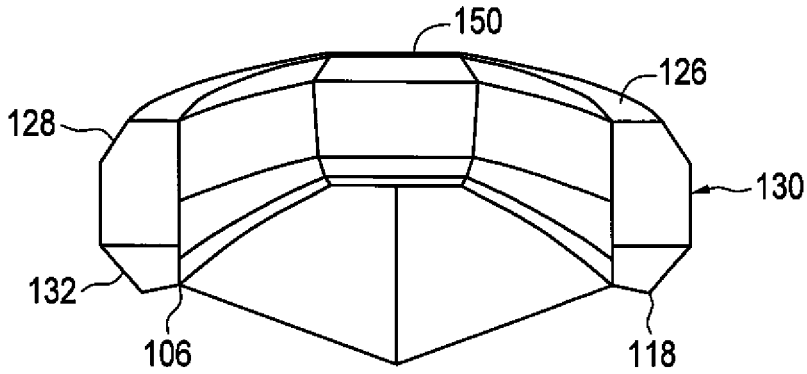
FIG. 8 is a rear elevational view of the buoyancy tube of FIGS. 5-7.
Figure 9:
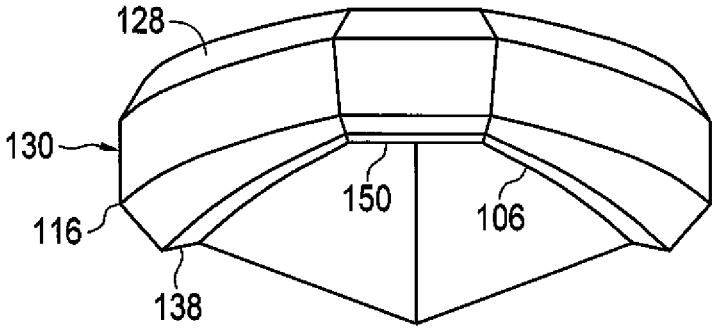
FIG. 9 is a front elevational view of the buoyancy tube of FIG. 5-7.

The initial cutting of sheet metal member 103 to produce portions cut out results in five splayed individual finger portions 140, 142, 144, 146 and 148, as shown in FIG. 6. The splayed finger portions are configured along their lengths so that the forward ends of the respective finger portions are somewhat narrower than the aft ends thereof. This is so that the splayed fingers can be pulled together and then welded to form the half-tube member, also referred to as a half buoyancy tube, curving slightly upwardly, terminating at a joined bow end, as shown in FIGS. 7-9. It is important that each half-tube member is made from a single piece of metal. The bow (forward) ends of fingers 140, 142, 144, 146 and 148 vary in width, from 2 inches for finger 148, to 6 inches for finger 146, 12 inches for finger 144, 5 inches for finger 142 and 3 inches for finger 140, although these end widths can vary. This resulting member 101 FIG. 11) forms one-half of the complete buoyancy tube 100 shown in FIGS. 7-9.

In the present arrangement, the bow ends of the respective two half-tube members forming a stabilizing bow, do not come to a point, although alternatively they could. They do curve upwardly to decrease water drag. In the embodiment shown, the complete buoyancy tube 100 includes a forward section 150 which is in the form of a keystone, which is approximately 2 feet wide at the forward end surface and approximately 1 foot wide at the rear surface. After each half-tube has been formed, the bow ends thereof are welded to the ends of forward section 150 to form the complete C-shaped buoyancy tube 100, as shown most clearly in FIGS. 7-9.

Figure 10:
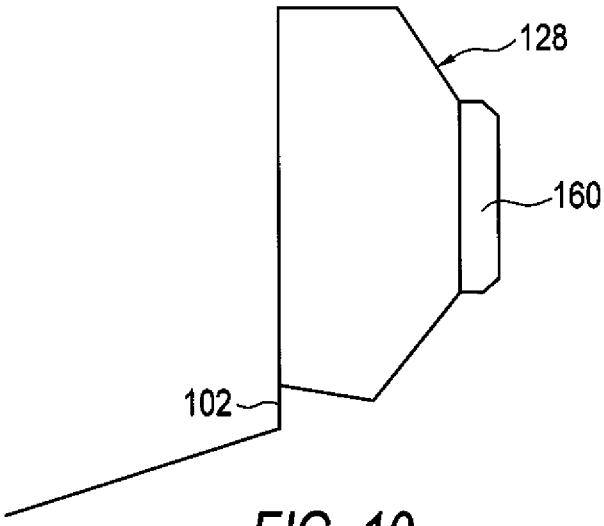
FIG. 10 is a cross-sectional view showing a foam member attached to the exterior surface of the stabilizing tube.

A further feature of the C-shaped stabilizing tube is the addition of a foam, or other non-rigid damage-tolerant member 160, for bump protection, to the exterior surface of the half-tube members. Member 160 can cover a portion of the exterior surface of the tube, such as shown in FIG. 10, or all of the tube.

Figure 11:
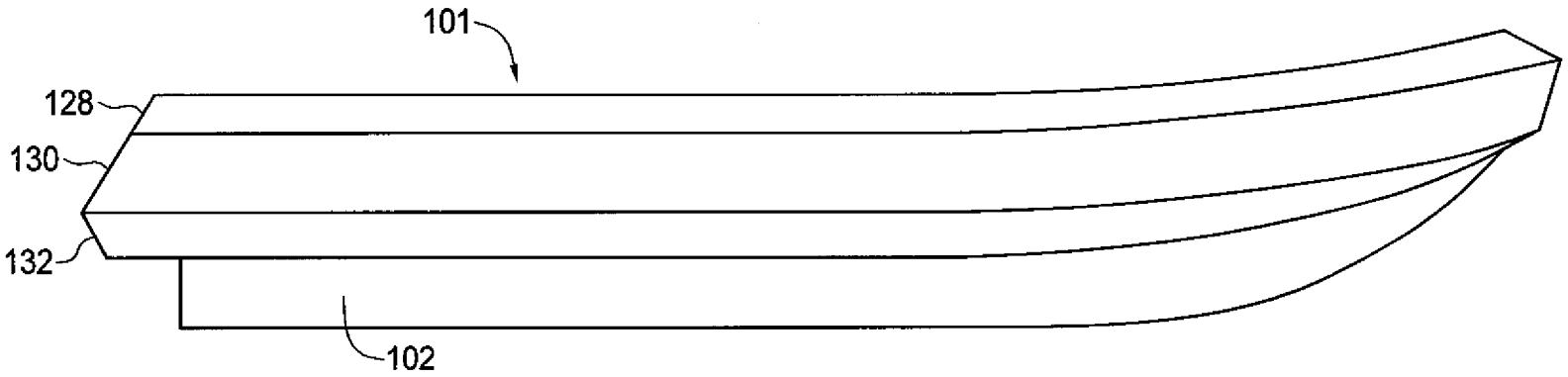
FIG. 11 is an elevational view showing one-half of the complete buoyancy tube of FIGS. 7-9.

The arrangement of FIGS. 5-11 has several advantages. It is readily attachable to an existing or new metal or other type of hull. The C-shape provides more interior space than circular inflatable or rigid tubes or D-shaped foam tubes. The present tube arrangement further has an added section of a flat front section to widen the bow, which typically will extend beyond the stem of the hull bottom to provide additional lift and buoyancy in the bow to mitigate the possibility of "pitch poling" the boat in heavy following seas. The stabilizing tube also typically extends back beyond the transom of the boat to provide additional lift and buoyancy when more weight is added to the stem of the boat by engines or fuel, as shown in FIG. 11.

The C-shaped rigid stabilizing/buoyancy tube disclosed herein thus has a number of advantages over existing buoyancy tubes.

Although a preferred embodiment of the invention has been disclosed for purposes of illustration, it should be understood that various changes, modifications and substitutions may be incorporated in the embodiment without departing from the spirit of the invention which is defined by the claims which follow.

What is claimed is:

1. A rigid stabilizing tube attachable to a hull of an otherwise fully functional watercraft, such that the stabilizing tube becomes integral with the hull, the stabilizing tube comprising:

a stabilizing tube which extends from a stern of a watercraft or beyond to a stabilizing bow of the watercraft or beyond, the stabilizing tube body comprising two half-tube sections, each half-tube section comprising a continuous single metal member having first and second spaced longitudinal edges attachable separately to the hull, each half-tube section having a length, wherein the single metal member has a plurality of spaced longitudinal bend lines between the first and second longitudinal edges along a portion of each half-tube section from an aft end to a selected point along the length thereof to form continuous C-shape in cross-section, wherein a remainder of each half-tube section to the stabilizing bow has portions cut out to define a plurality of separate, splayed finger portions, each finger portion being narrower at a forward end thereof, and then joined together along respective lengths thereof to a forward end of each half tube section, the two half-tube sections forming the stabilizing bow of the watercraft, or joined, respectively, to opposing ends of a separate forward section to form the stabilizing bow.

2. The stabilizing tube of claim 1, wherein the longitudinal bend lines form concatenated angles to provide sufficient rigidity to each half-tube section to form a C-shape in cross-section.

3. The stabilizing tube of claim 1, wherein the longitudinal bend lines comprise 2 or 3 bend lines defining 3 or 4 longitudinal sections between free edges of each half-tube section.

4. The stabilizing tube of claim 1, wherein the longitudinal bend lines comprise four lines defining five longitudinal sections between free edges of each half-tube section.

5. The stabilizing tube of claim 1, wherein an aft end of the stabilizing tube is sufficiently long to extend beyond a transom of the hull to which it is attached.

6. The stabilizing tube of claim 1, wherein the selected point is approximately 55% of the length of each half-tube section from an aft end thereof.

7. The stabilizing tube of claim 1, wherein the two half-tube sections are formed to curve upwardly from the selected point to the bow of the tube.

8. The stabilizing tube of claim 1, including an energy-absorbing member attachable to and extending along a substantial portion of the length of each half-tube section.

9. The stabilizing tube of claim 1, wherein the plurality of longitudinal bend lines define a plurality of sections and wherein a lowermost section is attachable along the second longitudinal edge to the hull of the watercraft at a positive, negative or flat angle.

10. The stabilizing tube of claim 9, wherein the lowermost section is attached to the hull at a chine or up to 8 inches above the chine.

* * * * *